US007500879B2

(12) United States Patent
Ting et al.

(10) Patent No.: US 7,500,879 B2
(45) Date of Patent: Mar. 10, 2009

(54) ELECTRICAL CARD CONNECTOR

(75) Inventors: Chien-Jen Ting, Tu-Cheng (TW); Tzu-Ching Tsai, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/986,194

(22) Filed: Nov. 20, 2007

(65) Prior Publication Data

US 2008/0119071 A1 May 22, 2008

(51) Int. Cl.
*H01R 24/00* (2006.01)

(52) U.S. Cl. ..... 439/630; 439/607

(58) Field of Classification Search ..... 439/630, 439/188, 64, 567, 607; 200/51.1
See application file for complete search history.

(56) References Cited

U.S. PATENT DOCUMENTS

| | | | | |
|---|---|---|---|---|
| 5,470,260 | A | 11/1995 | Schwan et al. | |
| 6,132,247 | A * | 10/2000 | Liou et al. | 439/567 |
| 6,261,113 | B1 * | 7/2001 | Chen | 439/260 |
| 6,638,105 | B1 * | 10/2003 | Wu | 439/567 |
| 6,641,441 | B2 * | 11/2003 | Liu | 439/630 |
| 6,929,513 | B2 * | 8/2005 | Fan | 439/630 |
| 7,234,969 | B2 * | 6/2007 | Chang et al. | 439/630 |
| 7,303,442 | B2 * | 12/2007 | Fan | 439/630 |
| 7,320,622 | B2 * | 1/2008 | Ying et al. | 439/630 |
| 2003/0119364 | A1 * | 6/2003 | Liu | 439/630 |
| 2006/0040561 | A1 | 2/2006 | Chang | |
| 2007/0218768 | A1 * | 9/2007 | Lee | 439/630 |

* cited by examiner

*Primary Examiner*—T C Patel
*Assistant Examiner*—Harshad C Patel
(74) *Attorney, Agent, or Firm*—Wei Te Chung

(57) ABSTRACT

An electrical card connector includes a metal shield (2), an insulated housing (3) and a terminal module (4). The metal shield defines a receiving room, in which a memory card is insertable in a card inserting direction through an insert opening generally at a front end thereof. The insulated housing is shielded by the metal shield, and defines a receiving portion (34) extending therethrough and adjacent to a rear end thereof. The terminal module is received in the receiving portion of the insulated housing and comprises a pair of locking boards (44) assembling the terminal module on a printed circuit board (5). A plurality of terminals (31) are insert-molded in the terminal module for electrical connection to the memory card.

18 Claims, 5 Drawing Sheets

ELECTRICAL CARD CONNECTOR

BACKGROUND OF THE INVENTION

1. Field of the Invention

The present invention relates generally to an electrical card connector, and particularly to such an electrical card connector installed on a printed circuit board.

2. Description of Related Arts

Memory cards are known in the art and contain intelligence in the form of a memory circuit or other electronic program. Some form of card reader reads the information or memory stored in the card. Such cards are used in many applications in today's electronic society, including video cameras, digital still cameras, smart phones, PDA's, music players, ATMs, cable television decoders, toys, games, PC adapters, multimedia cards and other electronic applications. Typically, a memory card includes a contact or terminal array for connection through a card connector to a card reader system and then to external equipment. The connector readily accommodates insertion and removal of the card to provide quick access to the information and program on the card. The card connector includes terminals for yieldingly engaging the contact array of the memory card.

The memory card connector is often mounted on a printed circuit board. The memory card, itself, writes or reads via the connector and can transmit between electrical appliances, such as a word processor, personal computer, personal data assistant or the like. With circuit board mounted connectors, the terminals of a connector include tail portions, which are connected to appropriate circuit traces on the printed circuit board through some manners, such as surface mount technology (SMT) wherein the tail portions are reflow soldered to the circuit traces, or through hole technology wherein the tail portions of the terminals are inserted into holes in the printed circuit board for connection, as by soldering, to circuit traces on the board and/or in the holes.

For example, U.S. Pat. No. 5,470,260 has shown a conventional electrical card connector that includes an insulated housing, a switch terminal, terminal wheels projecting into the card-receiving room and received in the terminal-receiving slots of the connector, and a board lock fixing the connector onto the printed circuit board. Having been molded in the insulated housing, the terminal wheels are soldered onto the printed circuit board. During the soldering process, the high temperature may cause the insulated housing to warp, accordingly, an electrical performance of the electrical card connector may be affected for this reason.

Hence, an improved electrical card connector assembly is desired.

SUMMARY OF THE INVENTION

Accordingly, an object of the present invention is to provide an electrical card connector with a preformed terminal module detachably assembled with the insulated housing.

Another object of the present invention is to provide an electrical card connector that can effectively prevent the insulated housing from warping.

To achieve the above object, an electrical card connector includes a metal shield, an insulated housing and a terminal module. The metal shield defines a receiving room, in which a memory card is insertable in a card inserting direction through an insert opening generally at a front end thereof. The insulated housing is shielded by the metal shield, and defines a receiving portion extending therethrough and adjacent to a rear end thereof. The terminal module is received in the receiving portion of the insulated housing and comprises a pair of locking boards assembling the terminal module on a printed circuit board. A plurality of terminals are insert-molded in the terminal module for electrical connection to the memory card.

Other objects, advantages and novel features of the invention will become more apparent from the following detailed description when taken in conjunction with the accompanying drawings.

DETAILED DESCRIPTION OF THE PREFERRED EMBODIMENT

Figure 1:
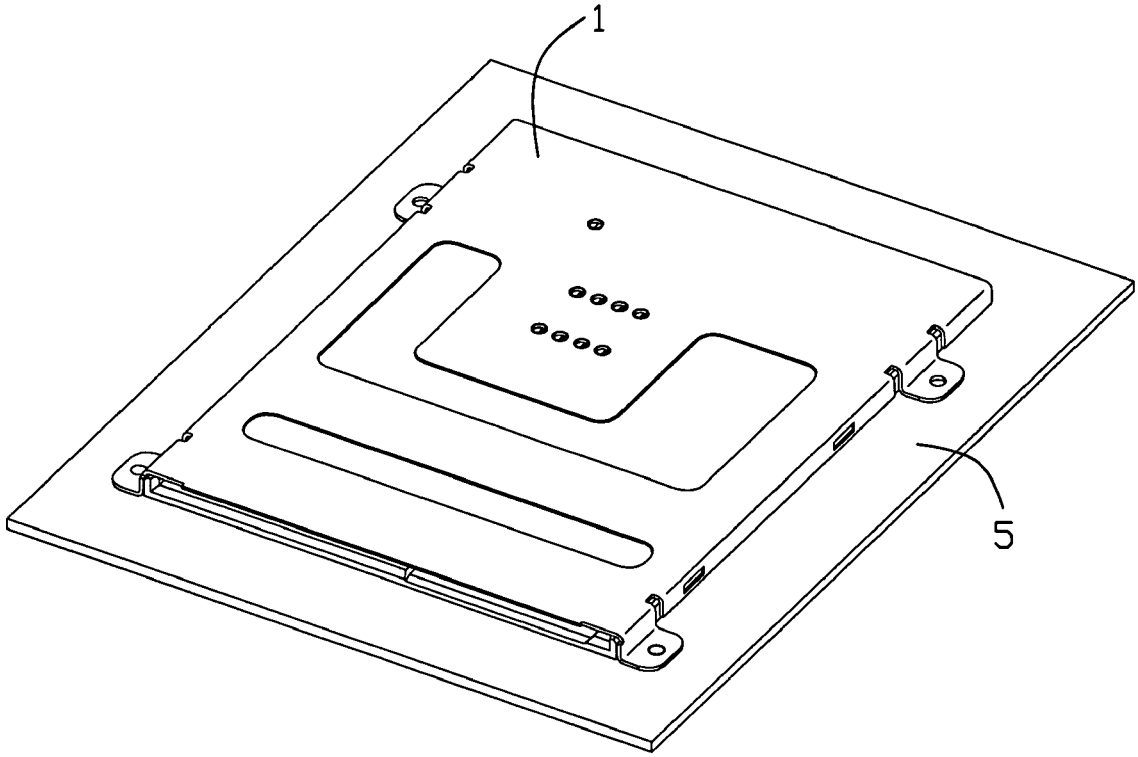
FIG. 1 is a perspective, assembled view of an electrical card connector installed on a printed circuit board in accordance with the present invention.

Referring to FIGS. 1-5, an electrical card connector 1 installed on a printed circuit board 5 according to a preferred embodiment of the invention comprises a metal shield 2, an insulated housing 3 and a terminal module 4 installed on the insulated housing 3. The metal shield 2 and the insulated housing 3 together define a receiving room (not labeled) for receiving an electrical card (not shown) and a card inserting direction.

Figure 2:
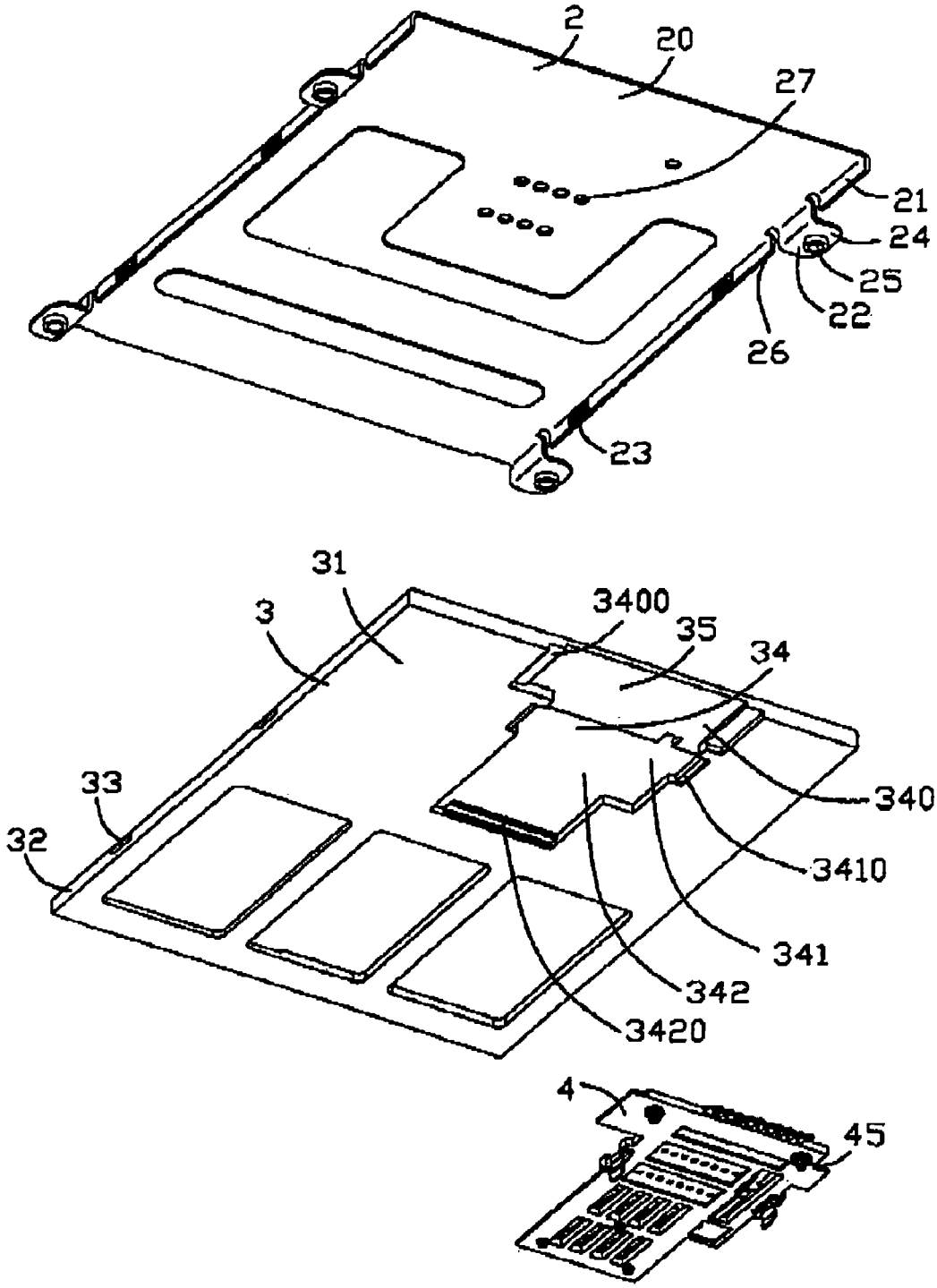
FIG. 2 is a perspective, exploded view of the electrical card connector.
Figure 3:
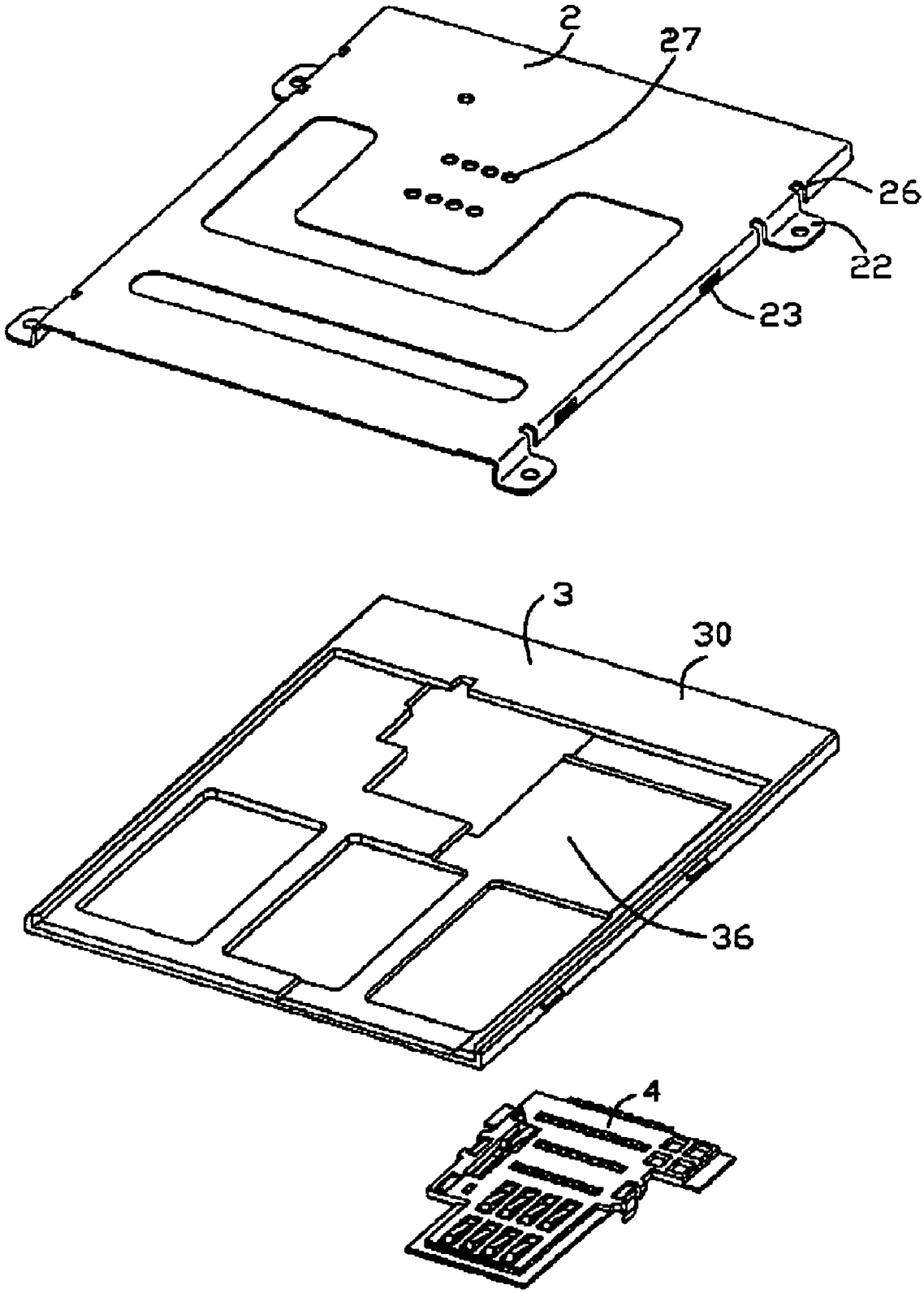
FIG. 3 is a view similar to FIG. 2, but taken from a different aspect.

Referring to FIGS. 2-3, the metal shield 2 of a generally rectangular shape, comprises a base 20 and two lateral sides 21 with a plurality of slots 23 defined thereon, extending vertically and upwardly from the edges of the base 20. A plurality of orientation pieces 22 extends horizontally and outwardly from the two lateral sides 21 with a protrusive piece 25 of perforation configuration formed thereon, in order to assemble the metal shield 2 on the printed circuit board 5. A plurality of notches 26 are arranged at the junctions of each lateral side 21 and the corresponding orientation pieces 22, so the lateral sides 21 are slightly tensile to let the insulated housing 3 be shielded easily by the metal shield 2. Moreover, a plurality of through holes 27 are defined on the base 20. The terms "vertically, upwardly and horizontally" are not meant to be limiting but is descriptive of depiction according to the claims.

Referring to FIGS. 2-3, the insulated housing 3 comprises an upper face 30, a lower face 31 and two lateral walls 32. A plurality of protruding portions 33 are formed on the lateral walls 32 for mating with the slots 23 of the metal shield 2 (or the protruding portions formed on the metal shield 2 and the slots formed on the insulated housing 3). The upper face 30 is a mating surface of the insulated housing 3 to mate with the printed circuit board 5, and at a rear end thereof along the card inserting direction forms a receiving portion 34 extending through an upper face and lower face, receiving the terminal module 4. The receiving portion 34 comprises a front-receiving portion 340, a middle-receiving portion 341 and an L-shaped receiving portion 342. The width of the front-receiving portion 340 is larger than that of the middle-receiving portion 341. The front-receiving portion 340 forms a pair of first step-shape pieces 3400, respectively, extending inwardly from corresponding lateral sides thereof. The first step-shape pieces 3400 are aligned with a baffle board 35 that is a part of the lower face 31. Similarly, the middle-receiving portion 341 forms a pair of second step-shape pieces 3410, respectively, extending inwardly from corresponding lateral sides thereof, and the L-shaped receiving portion 342 forms a third step-shape piece 3420 extending from a front part thereof along the card inserting direction. The lower face 31 comprises a depressed portion 36, so that the insulated housing 3 and the metal shield 2 integrally define said receiving room for receiving the electrical card (not shown).

Figure 4:
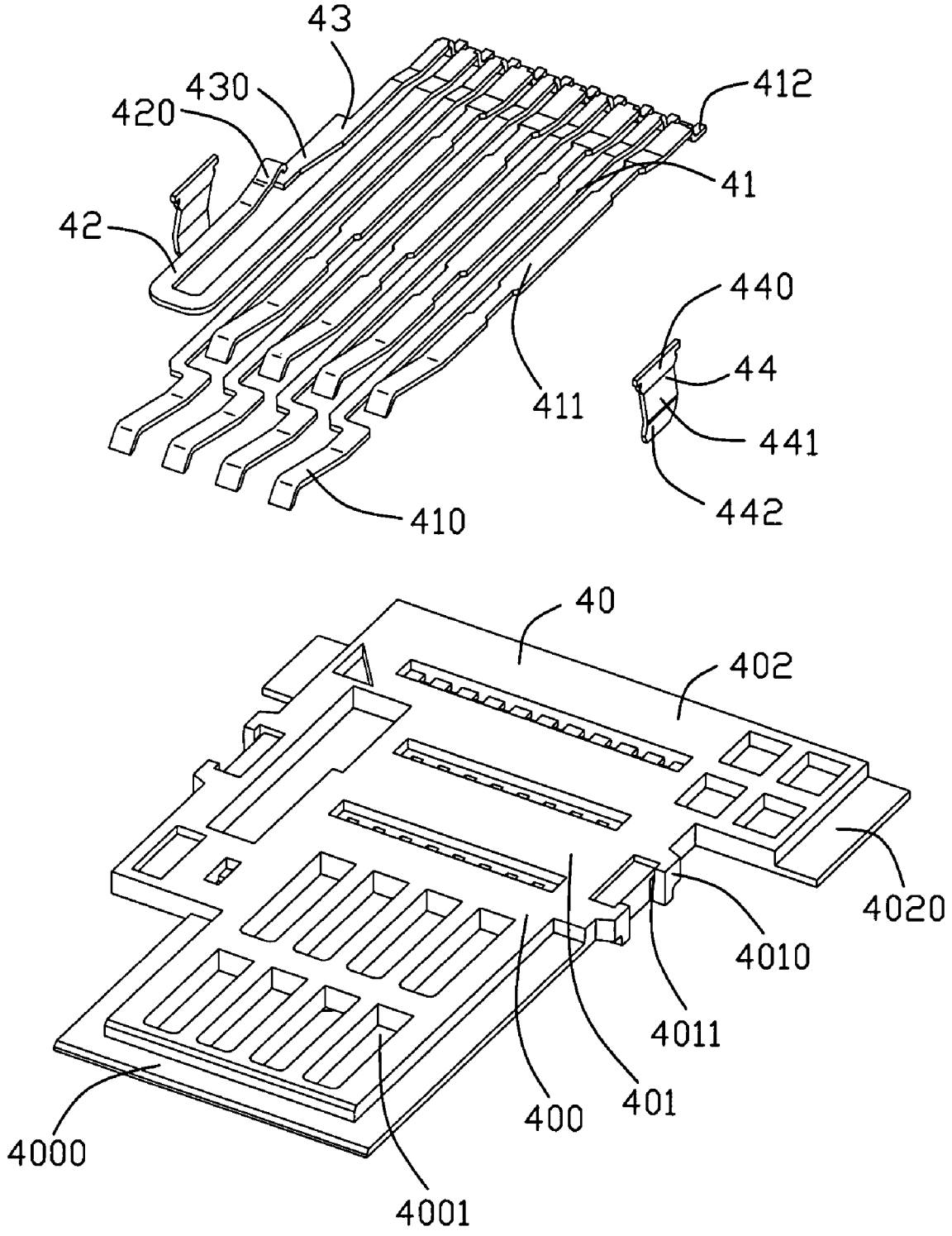
FIG. 4 is an exploded view of the terminal module.
Figure 5:
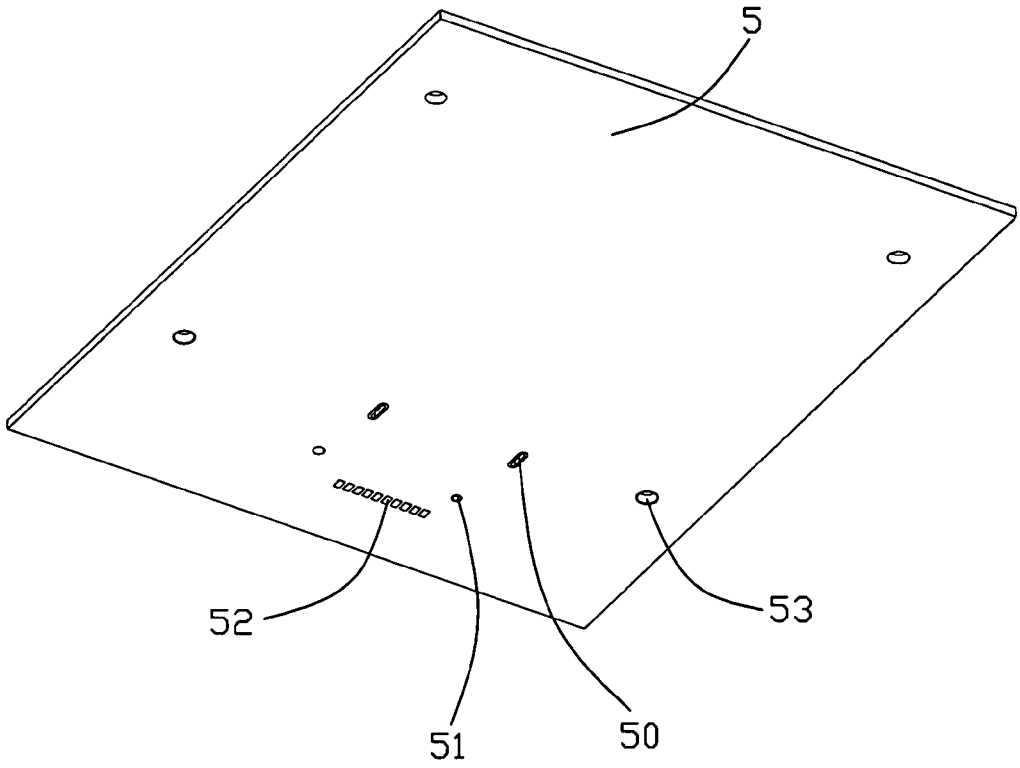
FIG. 5 is a perspective view of the printed circuit board.

Referring to FIG. 2 in conjunction with FIG. 4, the terminal module 4 comprises a body portion 40 with an upper surface (not labeled) and a lower surface (not labeled). The upper surface is defined as a mating surface of the terminal module 4 mating with the inserted electrical card, and the lower surface is defined as a mating surface of the terminal module 4 mating with the printed circuit board 5. The terminal module 4 comprises a plurality of signal terminals 41, an active terminal 42 and a passive terminal 43 together forming a set of switch mechanism (not labeled), a pair of locking boards 44 and a pair of protrusions 45 formed on the lower surface to connect the terminal module 4 on the printed circuit board 5.

The body portion 40 comprises a rectangle portion 402 with a largest width, a rectangular portion 401 extending forwardly from the rectangle portion 402 with a width smaller than that of the rectangle portion 402 and an L-shaped portion 400 extending continuatively and forwardly from the rectangular portion 401. The rectangle portion 402 comprises a pair of first tongue portions 4020 extending laterally from lateral sides thereof. The first tongue portions 4020 mates with the pair of the first step-shape pieces 3400. The rectangular portion 401 forms a pair of locking portions 4010 on both sides, and each forms a groove 4011. The locking boards 44 are respectively received in the corresponding grooves 4011. The L-shaped portion 400 comprises a second tongue portion 4000 extending forwardly from a front part thereof for mating with the third step-shape piece 3420 of the insulated housing 3. Two rows of receiving recesses 4001 are arranged in front-to-rear linear arrays along the card inserting direction and defined on the L-shaped portion 400 of the body portion 40.

Each signal terminal 41 comprises a contacting portion 410 mating with the corresponding contact (not shown) of the inserted electrical card, a linking portion 411 and a rear portion 412 soldered to the printed circuit board. The signal terminals 41 comprise a plurality of first terminals (not labeled) and a plurality of second terminals (not labeled) arranged alternatively with the first terminals. The rear portions of the signal terminals 41 are arranged in a line, the linking portions of the second terminals are longer than those of the first terminals, the contacting portions of the second terminals are bended laterally and located at a front of the contacting portions of the first terminals along a direction opposite to the card inserting direction. The two rows of the contacting portions 410 of the signal terminals 41 are respectively received in corresponding receiving recesses 4001, beyond the upper surface of the body portion 40 and extending into the receiving room. Said active terminal 42 forms a suppressing portion 420 cantilevered relative to a manual portion 430 of the passive terminal 43. When the electrical card is inserted, the suppressing portion 420 and the manual portion 430 connecting with each other under a pressure acting on the suppressing portion 420 from the card, so that the signal is transferred; when the force is removed, the suppressing portion 420 and the manual portion 430 are separated from each other, and there are no signals. All the terminals 41, 42, 43 are insert-molded in the terminal module 3 preformedly. Each locking board 44 comprises an assembling portion 440 located in the corresponding groove 4011, an inclined portion 441 extending downward from the assembling portion 440 and a fixing portion 442. For the shape of the terminal module 4 is approximately the same as the shape of the receiving portion 34, the terminal module 4 is entirely received in the receiving portion 34.

The printed circuit board 5 comprises a pair of slits 50, a pair of round holes 51, a plurality of soldered portions 52 and a plurality of orientation holes 53. The fixing portion 442 of the locking board 44 are received in the slits 50. The protrusions 45 of the body portion 40 are received in the round holes 51. The soldered portions 52 are used for electrically connecting with the rear portions 412. The orientation holes 53 mate with the corresponding orientation pieces 22 of the metal shield 2 for assembling the whole electrical card connector 1 onto the printed circuit board 5.

Because the insulated housing 3 and the terminal module 4 are separated with each other, the terminal module 4 is soldered onto the printed circuit board 5 first, after the insulated housing 3 and the metal shield 2 are assembled with each other, and then, the combination of the insulated housing 3 and the metal shield 2 are assembled onto the terminal module 4. So, it can effectively prevent the insulated housing 3 from warping because the insulated housing 3 need not go through the high temperature in the soldering process. Second, the locking boards 44 prevent the terminal module 4 from dropping down for the high temperature during other elements' soldering.

While a preferred embodiment in accordance with the present invention has been shown and described, equivalent modifications and changes known to persons skilled in the art according to the spirit of the present invention are considered within the scope of the present invention as described in the appended claims.

We claim:

1. An electrical card connector for receiving a memory card, comprising:

a metal shield defining a receiving room, in which a memory card is insertable in a card inserting direction through an insert opening generally at a front end thereof;

an insulated housing shielded by the metal shield, the insulated housing defining a receiving portion extending through an upper face and a lower face thereof and adjacent to a rear end thereof; and a terminal module received in the receiving portion of the insulated housing, the terminal module comprising a plurality of terminals insert-molded therein for electrical connection with the memory card and a pair of locking boards assembling the terminal module on a printed circuit board separately.

2. The electrical card connector as described in claim 1, wherein the terminal module forms a mating surface, which is accessible from the receiving room, and mating ends of the terminals inwardly extend towards the receiving room and beyond the mating surface.

3. The electrical card connector as described in claim 2, wherein the terminal module defines a soldering surface opposite to the mating surface for facing to a printed circuit board.

4. The electrical card connector as described in claim 2, wherein the terminal module ins two rows of receiving recesses in a liner array along the card inserting direction to receive the terminals.

5. The electrical card connector as described in claim 4, wherein the terminals have a plurality of first signal terminals and a plurality of second signal terminals arranged alternatively with the first terminals, and each signal terminal comprises a contacting portion mating with a corresponding contact of the inserted electrical card, a linking portion and a rear portion soldered to the printed circuit board.

6. The electrical card connector as described in claim 5, wherein the rear portions of the signal terminals are arranged in a line, the linking portions of the second terminals are longer than those of the first terminals, and the contacting portions of the second terminals are bent laterally and located at a front of those of the first terminals along a direction opposite to the card inserting direction.

7. The electrical card connector as described in claim 1, wherein the terminal module has a transverse rectangle portion, with a largest width thereof and the insulated housing has a front-receiving portion for receiving the rectangle portion fixedly.

8. The electrical card connector as described in claim 7, wherein the terminal module has a transverse rectangular portion extending forwardly from the rectangle portion, with a width being smaller than that of the rectangular portion, and the insulated housing has a rectangular-receiving portion for receiving this rectangular portion fixedly.

9. The electrical card connector as described in claim 8, wherein the terminal module has an L-shaped portion extending forwardly from the rectangular portion, and the insulated housing has an L-shaped receiving portion for receiving the L-shaped portion fixedly.

10. The electrical card connector as described in claim 8, wherein the locking boards are formed at two lateral sides of the rectangular portion, and each locking board has a fixing portion fixing the terminal module on the printed circuit board.

11. The electrical card connector as described in claim 10, wherein the rectangular portion forms a pair of locking portions on both sides thereof, each locking portion forms a groove, and each locking board comprises an assembling portion located in a corresponding groove.

12. The electrical card connector as described in claim 1, wherein the terminal module is spaced a distance relative to two lateral sides of the insulated housing along a transverse direction crossing the card inserting direction.

13. An electrical card connector for receiving a memory card, comprising:

a metal shield defining a receiving room in which a memory card is insertable in a card inserting direction through an insert opening generally at a front end thereof;

an insulated housing shielded by the metal shield, and defining opposite top and bottom faces with a receiving portion extending through both said top face and said bottom face and adjacent to a rear end thereof; and a terminal module comprising a pair of board locks assembling the terminal module on a printed circuit board, the terminal module having a shape approximately similar to the shape of the receiving portion and being received in the receiving portion separately.

14. A card connector assembly comprising:

a printed circuit board;

a terminal module including an insulator equipped with a plurality of terminals thereof, said terminal module fastened to the printed circuit board via at least one board lock;

a combination including an insulative housing and a metallic shell fastened to each other and commonly define horizontal card receiving cavity under a condition that said housing defines an opening directly and intimately facing the printed circuit board, and is fastened on the printed circuit board; wherein said opening receives said terminal module, and contacting portions of the terminals extend into the card receiving cavity.

15. The connector assembly as claimed in claim 14, wherein said housing is fastened to the printed circuit board via a non-soldering process.

16. The connector assembly as claimed in claim 14, wherein said opening is smaller than the terminal module so as to assure that said terminal module can not upwardly leave the housing and is only allowed to be mounted to the printed circuit board before the housing is mounted to the printed circuit board.

17. The connector assembly as claimed in claim 14, wherein a bottom face of the terminal module is essentially coplanar with a bottom surface of the housing.

18. The connector assembly as claimed in claim 14, wherein the opening extends trough the housing in a vertical direction.

* * * * *